United States Patent [19]

Schulze

[11] Patent Number: 4,551,188

[45] Date of Patent: Nov. 5, 1985

[54] DEVICE FOR LIFTING THE FLAPS OF LETTERS OR ENVELOPES

[75] Inventor: Wolfgang Schulze, Berlin, Fed. Rep. of Germany

[73] Assignee: Francotyp-Postalia GmbH, Berlin, Fed. Rep. of Germany

[21] Appl. No.: 661,244

[22] Filed: Oct. 15, 1984

[30] Foreign Application Priority Data

Oct. 13, 1983 [DE] Fed. Rep. of Germany ..... 3337488

[51] Int. Cl.[4] ..... B65B 9/08

[52] U.S. Cl. ..... 156/441.5; 53/382; 53/383

[58] Field of Search ..... 156/442, 441.5, 442.1, 156/442.2; 53/382, 383, 384, 385

[56] References Cited

U.S. PATENT DOCUMENTS

| | | | |
|---|---|---|---|
| 2,944,511 | 2/1960 | Bach et al. | 156/442.1 X |
| 3,474,711 | 10/1969 | Swinyar | 156/442 X |
| 3,550,351 | 12/1970 | Gombault | 53/383 X |
| 4,336,681 | 6/1982 | Onishi | 53/385 X |
| 4,393,640 | 7/1983 | Cole et al. | 53/385 X |

*Primary Examiner*—David Simmons

*Attorney, Agent, or Firm*—Herbert L. Lerner; Laurence A. Greenberg

[57] ABSTRACT

An envelope or letter closing device of a postal article processing machine, includes a moistening device having a holding plate, a feeder mechanism disposed upstream of the moistening device in travel direction of the letters or envelopes for feeding the letters or envelopes to the moistening device, and a device for lifting the flaps of the envelopes or letters, the lifting device including a compressed air issuing device with an outlet opening, and a sensing device disposed in the feeder mechanism and connected to the compressed air issuing device, the sensing device causing the compressed air issuing device to issue an air stream from the outlet opening upon sensing letters or envelopes passing by for lifting the flaps of unsealed envelopes or letters and conducting the flaps below the holding plate for moistening.

5 Claims, 2 Drawing Figures

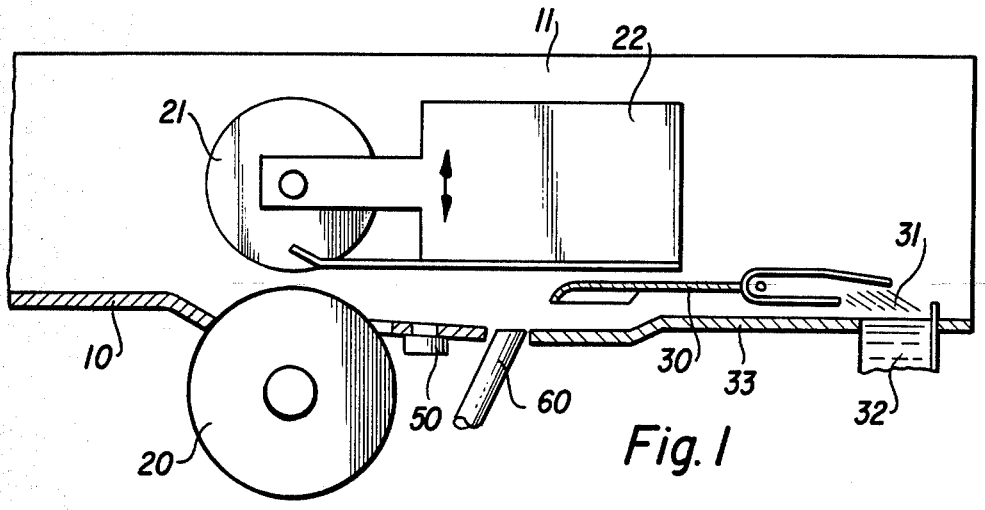
Fig. 1
Fig. 2
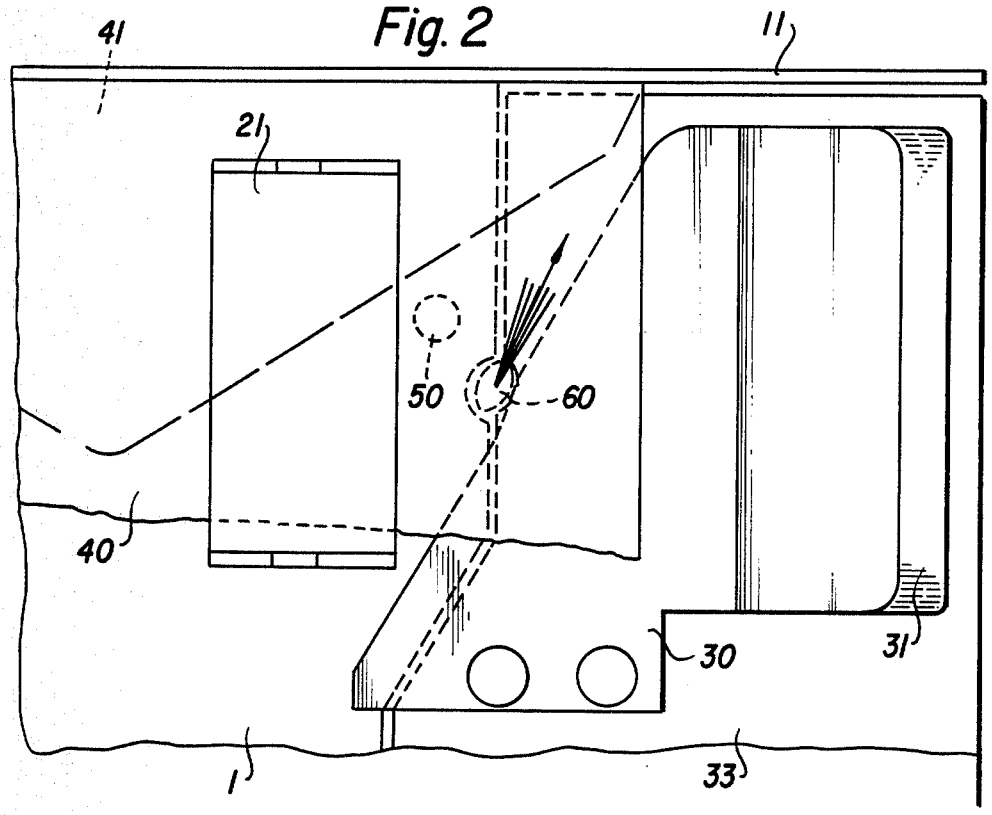

DEVICE FOR LIFTING THE FLAPS OF LETTERS OR ENVELOPES

The invention relates to a device for lifting the flaps of letters or envelopes in feeder mechanisms of letter closing devices for postal article processing machines.

During the processing of letters or envelopes by machine, it is conventional to conduct the letters or envelopes over a holding plate, which either lifts the flap of the letter or envelope so that it is guided over a moistening device, or leaves the flap of the letter or envelope in its original position and moves the letter along without touching the moistening device, dependent on the position of the holding plate. Such a device is described in German Published, Non-Prosecuted Application DE-OS No. 23 20 484. For this purpose, a mechanical shifting mechanism is provided which controls a deflection member. A mechanism of this type is not practical for the mixed processing of letters, wherein some of the envelopes or letters are open, and some are already closed, because it requires continuous manual shifting, and therefore is labor intensive, uneconomical and additionally requires costly mechanical investment.

It is accordingly an object of the invention to provide a device for lifting the flaps of envelopes or letters, which overcomes the hereinafore-mentioned disadvantages of the heretofore-known devices of this general type, and which permits the mixed processing of letters and envelopes which are already closed and which are still open, in such a way that only the flaps of envelopes or letters which are still open are conducted over the moistening device.

With the foregoing and other objects in view there is provided, in accordance with the invention, an envelope or letter closing device of a postal article processing machine, comprising a moistening device having a holding plate, a feeder mechanism disposed upstream of the moistening device in travel direction of the letters or envelopes for feeding the letters or envelopes to the moistening device, and a device for lifting the flaps of the envelopes or letters, the lifting device including a compressed air issuing device with an outlet opening, and a sensing device disposed in the feeder mechanism and connected to the compressed air issuing device, the sensing device causing the compressed air issuing device to issue an air stream from the outlet opening upon sensing letters or envelopes passing by for lifting the flaps of unsealed envelopes or letters and conducting the flaps below the holding plate for moistening.

In accordance with another feature of the invention, the compressed air issuing device is controlled by signal impulses.

In accordance with a further feature of the invention, the feeder mechanism includes a hold-down device disposed above the holding plate for holding down the envelopes or letters, the holding plate serving as a rest for the hold-down device.

In accordance with an added feature of the invention, the holding plate has a side with a triangular contour facing toward the feeding mechanism.

In accordance with a concomitant feature of the invention, the triangular contour of the holding plate is rounded off.

Other features which are considered as characteristic for the invention are set forth in the appended claims.

Although the invention is illustrated and described herein as embodied in a device for lifting the flaps of letters or envelopes, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 1 is a fragmentary, diagrammatic, partly cross-sectional, side-elevational view of a device for lifting flaps of letters or envelopes; and FIG. 2 is a fragmentary, top plan view of the device shown in FIG. 1, although the hold-down means are not shown in FIG. 2.

Referring now in detail to the figures of the drawings in which equivalent elements are indicated by the same reference symbols, there is seen a feeder mechanism of a letter closing device. The feeder mechanism includes a transport shaft 20, which is disposed in a cutout formed in a table plate 10, and a pressure roller 21 having a hold-down device 22 and being disposed opposite the transport roller 20. A moistening device is disposed downstream of the feeder mechanism 21, 22. Only the essential parts of the moistening device, such as a holding plate 30 for a brush 31, a sponge 32 and a cover 33 are shown in FIG. 1 and FIG. 2. The holding plate 30 of the moistening device also serves as a support for the hold-down device 22 during the rest state or condition of the machine.

A letter or envelope 40 with its flap 41 facing down toward the table plate 10, is conducted along a rear wall 11. The letter or envelope 40 is pushed onto the transport shaft 20 from a separating device, by rollers of a conveyor for postal articles, or by hand. The transport roller 20 in conjunction with the pressure roller 21 moves the letter or envelope 40 to the moistening device. The hold-down device 22 is accordingly moved in the direction of the arrow in FIG. 1 depending on the thickness of the letter, so that the letter or envelope first hits the holding plate 30 with the lower corner of a side edge. The holding plate 30 has a triangular contour at the side turned toward the transport shaft 20, and is rounded off downward in direction toward the cover 33. This shape causes the hold-down device 22 to be pushed up by the letter or envelope 40, which is thereby conducted above or over the holding plate.

A sensing or scanning device 50, for instance a light gate or light sensing device, is provided before or after the transport shaft 20. The sensing device 50 controls a compressed air issuing device. As a letter or envelope 40 passes, air is blown out from an outlet orifice 60 of the device. If an envelope or letter flap is open, the air opens the flap far enough so that it is pushed below the holding plate 30. Thus the flap 41 of an unclosed letter or envelope 40 reaches the brush 31 of the moistening device, is wetted there, and is closed by the pressure rollers which follow. A closed letter or envelope slides through above the moistening device.

The compressed air device is controlled by pulses from the sensing device 50, i.e. it is only activated during the time that a letter or envelope 40 slides by. Furthermore, an additional sensing or scanning device can be provided at the holding plate 30, or at the cover 33, for example, which causes the air stream to be turned off, as soon as the letter flap glides under the holding plate 30, or if a closed letter or envelope has moved a certain distance over the holding plate.

I claim:

1. An envelope or letter closing device of a postal article processing machine, comprising a moistening device having a holding plate, a feeder mechanism disposed upstream of said moistening device in travel direction of the letters or envelopes for feeding the letters or envelopes to said moistening device, and a device for lifting the flaps of the envelopes or letters, said lifting device including a compressed air issuing device with an outlet opening, and a sensing device disposed in said feeder mechanism and connected to said compressed air issuing device, said sensing device causing said compressed air issuing device to issue an air stream from said outlet opening upon sensing letters or envelopes passing by for lifting the flaps of unsealed envelopes or letters and conducting the flaps below said holding plate for moistening.

2. Device according to claim 1, wherein said compressed air issuing device is controlled by signal impulses.

3. Device according to claim 1, wherein said feeder mechanism includes a hold-down device disposed above said holding plate, for holding down the envelopes or letters, said holding plate serving as a rest for said hold-down device.

4. Device according to claim 3, wherein said holding plate has a side with a triangular contour facing toward said feeder mechanism.

5. Device according to claim 4, wherein said triangular contour of said holding plate is rounded off.

* * * * *